United States Patent [19]

Mankey

[11] 4,369,989

[45] Jan. 25, 1983

[54] STABILIZING JACK FOR SKID STEER VEHICLE

[75] Inventor: Harry S. Mankey, Dallas, Tex.

[73] Assignee: Standard Manufacturing Company, Incorporated, Dallas, Tex.

[21] Appl. No.: 174,642

[22] Filed: Aug. 1, 1980

[51] Int. Cl.[3] ..... B60S 9/02

[52] U.S. Cl. ..... 280/763; 254/86 R; 254/94

[58] Field of Search ..... 280/763, 764, 765, 766, 280/767; 254/86 H, 86 R-86 Y, 94 Y, 49, 50; 248/352; 212/244, 254; 180/22, 23, 24.11, 6.58

[56] References Cited

U.S. PATENT DOCUMENTS

| | | | |
|---|---|---|---|
| 1,682,910 | 9/1928 | Jaeger | 254/86 R |
| 1,817,190 | 8/1931 | Hall | 254/86 R |
| 2,108,888 | 2/1938 | Gunter | 254/86 R |
| 2,240,430 | 4/1941 | Willard | 254/86 R |
| 2,245,800 | 6/1941 | McDonald | 254/94 |
| 2,267,856 | 12/1941 | DiCarlo | 254/86 R |
| 2,709,066 | 5/1955 | Stapleton | 254/94 |
| 2,750,149 | 6/1956 | Mermelstein | 254/86 R |
| 3,083,987 | 4/1963 | Woolslayer et al. | 280/763 X |
| 3,398,972 | 8/1968 | Ekengard | 280/764 |
| 3,667,730 | 6/1972 | Kollmar | 280/766 X |
| 3,760,906 | 9/1973 | McGee | 280/763 X |
| 3,799,362 | 3/1974 | Oswald et al. | 180/24.11 X |
| 3,881,746 | 5/1975 | Newcomb, Jr. | 280/763 |
| 4,009,761 | 3/1977 | Meyer | 180/22 X |
| 4,084,789 | 4/1978 | Francis | 254/86 R |
| 4,210,218 | 7/1980 | Oswald et al. | 180/24.12 |
| 4,210,219 | 7/1980 | Oswald et al. | 180/24.12 |

*Primary Examiner*—Robert R. Song
*Assistant Examiner*—Milton L. Smith
*Attorney, Agent, or Firm*—Richards, Harris & Medlock

[57] ABSTRACT

In a first embodiment, stabilizing jacks (60) are pivotally mounted on the frame assembly (14) of a skid steered vehicle (10) to stabilize the vehicle. A jack (60) is pivotally mounted at a first end of each of the elongate load bearing frames (18) of the frame assembly (14). The jacks (60) may be released from a storage position so that a first edge (65) of the jack engages the surface. Propelling the vehicle (10) forward pivots the jacks (60) onto a support surface (68). In this position, the vehicle (10) is supported on the jacks (60), middle wheel members (44) and the rear wheel members (46). The vehicle (10) may be propelled rearward to pivot the jacks (60) out of the support position. A cylinder (30) having a piston connected to a cable (70) maintains the jacks (60) in a storage position after use. In a second embodiment, jacks (92) are mounted on a cross tube (88) extending between the load-bearing frames (18).

7 Claims, 7 Drawing Figures

STABILIZING JACK FOR SKID STEER VEHICLE

TECHNICAL FIELD

This invention relates to vehicles employing skid steering, and more particularly, to a jack for stabilizing a skid steered vehicle.

BACKGROUND ART

U.S. Pat. No. 3,799,362, issued Mar. 26, 1974, discloses and claims a vehicle comprising three pairs of opposed wheels positioned along opposite sides of the vehicle, and wherein the wheels at the center extend beneath the wheels at the opposite ends of the vehicle. In application Ser. No. 115,942, filed Jan. 28, 1980, an undercarriage for supporting and propelling a mechanism is disclosed which includes at least three wheels rotatably supported at spaced points along a frame, with the middle wheel extending below a plane lying tangent to the bottoms of the endmost wheels. Application Ser. No. 112,727, filed Jan. 17, 1980, discloses and claims an interchangeable undercarriage unit also including a middle or center wheel extending below endmost wheels.

Vehicles in corporating the structure disclosed in the above recited applications accomplish the objective of having both short and long wheelbases by means of lower middle wheels. For example, when operated over a hard, smooth surface, the vehicle will rest only on the middle wheels and one pair of endmost wheels determined by the location of the overall center of gravity of the vehicle at a given moment. The effective wheel base of the vehicle comprises the distance between the middle wheels and the pair of the endmost wheels in contact with the surface. Consequently, the effort required to effect steering of the vehicle is substantially reduced over that which would be required if the wheelbase comprised the distance between both pairs of endmost wheels. If the vehicle is operated over an adverse terrain, such as sand, mud or loose dirt, all three pairs of wheels will engage the adverse surface because they will sink into the adverse surface until vehicle flotation occurs. Superior traction will be achieved as each wheel directly contacts the surface. Typically, the wheels will comprise pneumatic tires formed from a rubber compound to enhance flotation and traction.

It has been found in several applications of the vehicle that increased stability would be desirable. In addition, the resilient nature of the pneumatic wheels has caused the vehicle on occasion to bounce or oscillate as the center of gravity of the vehicle is shifted from opposite sides of the middle wheels as a load is transfered to and from the vehicle during operation. This has been found to reduce the efficiency of the vehicle.

DISCLOSURE OF THE INVENTION

In accordance with the present invention, a jack for use with an undercarriage unit is provided.

One aspect of the invention provides a vehicle supported on a surface. The vehicle comprises a frame assembly and at least three sets of wheel members rotatably supported along the length of the frame assembly for supporting the vehicle on the surface. The middle set of wheel members extend below a plane lying tangent to the bottoms of the endmost sets of wheel members. The vehicle further comprises jack structure mounted on the frame assembly adjacent an endmost set of wheel members for movement to a support position so that when the jack structure mounted on the frame assembly is in the support position, the vehicle is supported on the surface by the middle set of wheel members, the opposite endmost set of wheel members and the jack structure to stabilize the vehicle.

In accordance with another aspect of the present invention, an improved vehicle is provided of the type having at least three sets of wheel members to support the vehicle on a surface with the middle set of wheel members extending below a plane lying tangent to the bottoms of the endmost sets of wheel members. The improvement comprises jack structure pivotally mounted to the vehicle adjacent a first set of endmost wheel members and pivotal to a support position so that the vehicle is supported on the surface by the jack structure, the middle set of wheel members and the endmost set of wheel members opposite the first set of endmost wheel members to stabilize the vehicle.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
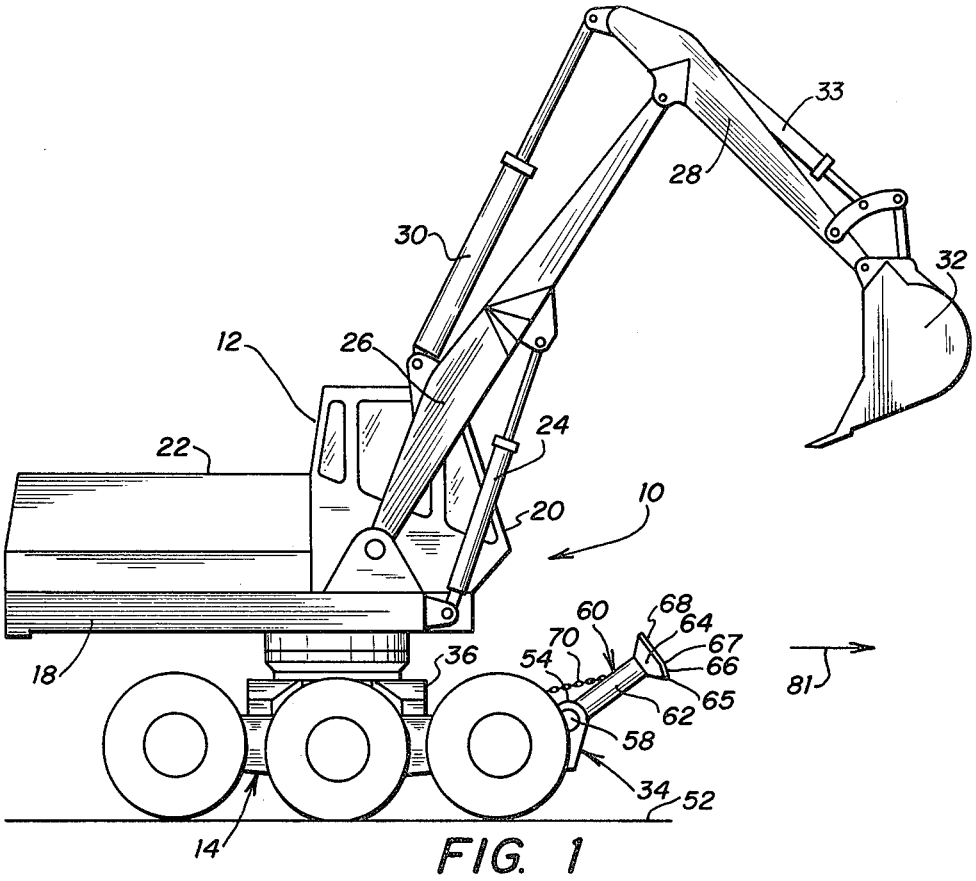
FIG. 1 is a side view of a vehicle having stabilizing jacks mounted thereon in accordance with a first embodiment of the present invention.

Referring now to the drawings, wherein like reference characters designate like or corresponding parts throughout several views, a vehicle 10 comprising a first embodiment of the present invention is illustrated in FIGS. 1–5. A mechanism 12 for performing a desired function is pivotally mounted on a frame assembly 14. The frame assembly 14 has a plurality of wheel members for supporting and propelling the vehicle along a surface.

The mechanism 12 illustrated in FIG. 1 is in the form of an excavator. The excavator includes a frame 18 supporting a cab 20 for the operator and a compartment 22 in which a prime mover is located. A cylinder 24 actuates the boom section 26 which is pivoted to frame 18. A second boom section 28 is pivotally mounted at the end of boom section 26. Movement of boom section 28 is effected by a cylinder 30. A bucket 32 is located at the end of boom section 28 and is actuated by a cylinder 33.

The frame assembly 14 includes a pair of undercarriages 34 rigidly interconnected in a parallel relationship by a cross member 36. The cross member 36 is adapted to mount mechanism 12 thereon for pivotal or rotational motion. Each of the undercarriages 34 comprises an elongate hollow load-bearing frame 38. The frame 38 has at least three axle members 40 rotatably supported at longitudinally spaced points along the frame. A set of forward wheel members 42 is mounted on opposed axle members 40 on each undercarriage 34. Middle wheel members 44 are similarly mounted on opposed axle members 40 on each undercarriage. Rear wheel members 46 are also mounted on opposed axle members 40. Each wheel member is formed from a tire which may be either solid or pneumatic. Preferably, each tire is formed from a rubber compound or other suitable resilient material.

A motor 48 and speed reducer 50 are secured to each undercarriage 34. A drive assembly within each of the hollow loadbearing frames 38 is operatively connected to the speed reducer 50. The drive assembly drives at least the middle wheel member 44, and preferably all the wheel members in unison. This drive assembly may comprise chains and sprockets, a gear train or a drive shaft assembly. Details of a suitable drive assembly are disclosed and claimed in co-pending application Ser. No. 115,942, filed Jan. 28, 1980, and incorporated herein by reference.

The set of middle wheel members 44 protrude below a plane 52 extending tangent to the bottom surfaces of the endmost wheel members comprising the sets of the forward wheel members 42 and rear wheel members 46. This may be accomplished by either providing larger diameter middle wheel members 44 or supporting the axle members 40 to which the middle wheel members 44 are mounted below the axle members mounting the endmost wheel members. Because the middle wheel members 44 are positioned below the plane 52, when the vehicle 10 is operated over a hard, smooth surface, it is supported on only two sets of wheels at any given moment, leaving one endmost set of wheel members raised off the surface. The wheelbase of the vehicle is therefore the distance between the middle wheel members and the endmost wheels members contacting the surface. This short wheelbase reduces the effort required to effect skid steering of the vehicle over that which would be required if the wheelbase comprised the distance between the endmost wheel members 42 and 46.

A clevis 54 is mounted at the front end of each frame 38. Each clevis 54 includes aligned holes for mounting a pivot pin 58 therein. A stabilizing jack 60 is pivotally mounted to each of the frames by the pivot pin 58.

Each stabilizing jack 60 comprises a relatively elongate shank 62 and a foot 64. A first edge 65 and a second edge 67 are defined on foot 64. The foot 64 also defines two faces disposed at an angle to each other. The faces include a stepping face 66 and support face 68. A chain or cable 70 is secured at one end to each jack 60. The opposite end is secured to a clevis 72 mounted at the end of the piston in fluid cylinder 74. Cylinder 74 is provided with a clevis 76 which is pivotally mounted to an extension 78 on the frame 38 by a pivot pin 80.

During operation it may be desirable to provide a support for the vehicle 10 in addition to that provided by the set of middle wheel members and the set of endmost wheel members which support the vehicle at a given moment to stabilize the vehicle. By stabilizing the vehicle, any bounce, rocking motion or oscillation in the vehicle may be reduced to negligible levels. The present invention provides for stabilizing vehicle 10 by use of stabilizing jacks 60 in a manner that will be described hereinafter.

Figure 2:
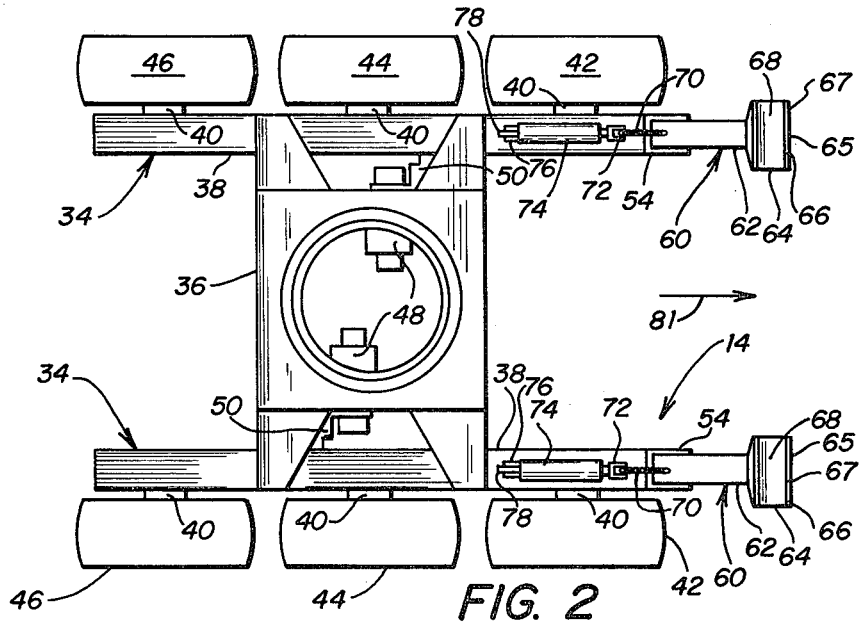
FIG. 2 is a top view of the undercarriage assembly of FIG. 1 illustrating the mounting of the jacks.
Figure 3:
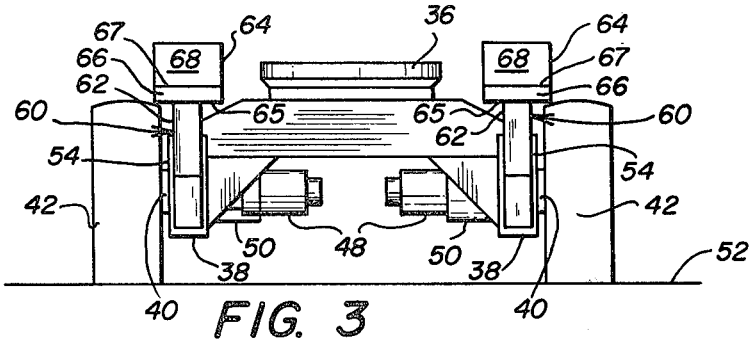
FIG. 3 illustrates an end view of the undercarriage assembly of FIG. 1.

When the vehicle 10 is in motion, or when the short wheel base provides adequate stabilization for a given operation, the jacks 60 are maintained in a storage position as shown in FIGS. 1 and 2. To position and maintain the jacks 60 in the storage position, the cylinders 74 are actuated. The cylinders draw the chains 70 and jacks 60 upward until a portion of each jack abuts against each clevis 54 in the storage position. In this storage position, the jacks do not interfere in the motion of vehicle 10.

Figure 4:
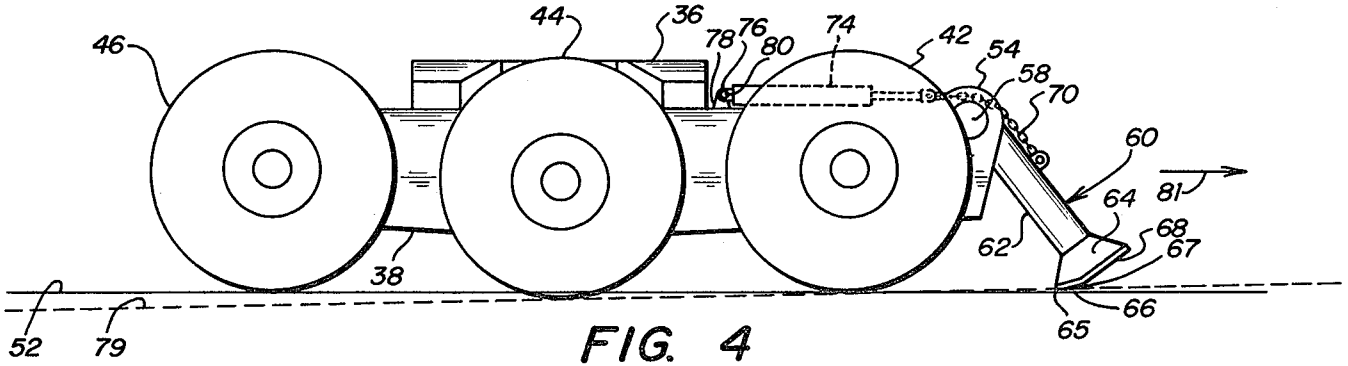
FIG. 4 illustrates a side view of the undercarriage assembly showing the jacks released from their storage position.

When it becomes desirable to stabilize the vehicle beyond the stability provided by the short wheelbase, the cylinder 74 is operated to allow jacks 60 to pivot around the pivot pin 58 downwardly under their own weight until they rest on the surface as shown in FIG. 4. In this position, a first edge 65 is in engagement with the surface 79. As vehicle 10 and frame assembly 14 are moved in the direction of arrow 81, the first edge 65 remains fixed and acts as a fulcrum about which jack 60 pivots until stepping face 66 contacts the surface 79. Second edge 67 engages the surface 79 and acts as a fulcrum to further pivot jack 60 into the support position with the support face 68 contacting the surface 79. In this position, each jack 60 may also abut against each frame 38. As jacks 60 pivot into the support position, the front end of each of the frames 38 is lifted. In the support position, jacks 60 provide a stable support for supporting the front end of the frames 38 on the surface. The stepping face 66 is positioned at an angle relative to the support face 68 so that as the vehicle 10 and frame assembly 14 move in the direction of arrow 81, each of the jacks 60 pivots onto the stepping face 66 and support face 68 in a smooth transition.

Figure 5:
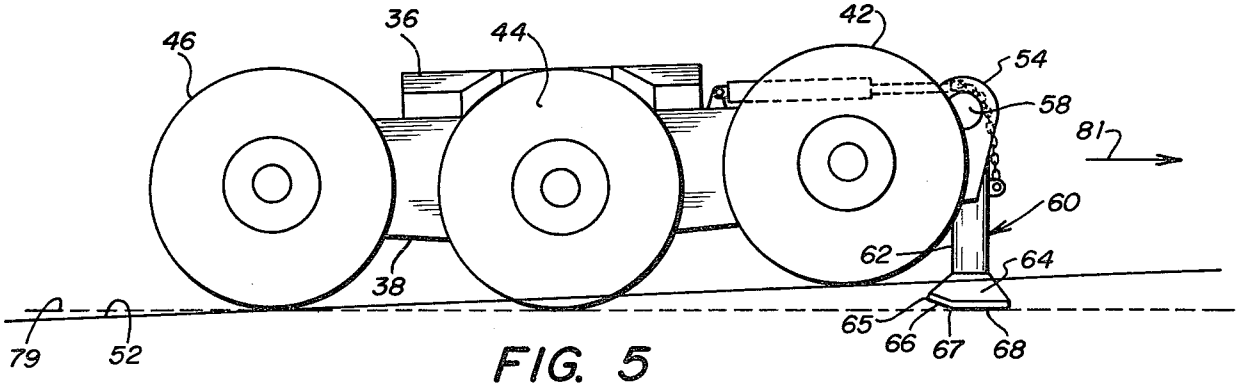
FIG. 5 is a side view of the undercarriage assembly illustrating the jacks in the support position.

When the jacks 60 are in the support position, as shown in FIG. 5, the vehicle 10 is supported on the jacks 60, the set of middle wheel members and the set of endmost wheel members opposite the jacks. The vehicle 10 is thereby stabilized.

In order to lower the vehicle 10 off the jacks 60, it is only necessary to move the vehicle 10 and frame assembly 14 in the direction opposite arrow 81 so that each of the jacks pivots off the faces 66 and 68. The jacks 60 may then be pivoted into the storage position by actuating cylinders 74 to draw the chains 70 and pivot jacks 60 into the storage position. Alternatively, the vehicle 10 and frame assembly 14 may continue moving in the direction opposite arrow 81, dragging the jacks 60 along the surface, until the vehicle reaches the next position for stabilization. The vehicle 10 and frame assembly 14 are again driven in the direction of arrow 81 to pivot the jacks 60 into the support position.

The use of jacks 60 and their mounting on the frames 38 does not interfere with the movement of an excavator bucket or shovel. Either of the jacks 60 may be used independently of the other to support one frame 38 of the vehicle 10. This may be desirable when rough terrain is encountered. In addition, structure may be incorporated into a jack 60 for adjusting the distance between the pivotal mounting of the jack and the support face, such as a screw jack or other suitable mechanism.

The use of jacks 60 provides a substantial advantage over the use of a conventional outrigger type mechanism for several reasons. An outrigger mechanism typically employs hydraulic lift which supports a substantial portion of the entire weight of the vehicle. An outrigger mechanism therefore requires a source of high pressure hydraulic fluid, commonly at a pressure of 2,500 p.s.i. With jacks 60, the vehicle is lifted by simple mechanical action and the weight of the vehicle is supported through rigid elements. Only a relatively low pressure hydraulic fluid source is needed to operate cylinders 74. In one operating prototype of the present invention, a source pressure of 300 p.s.i. was found to be adequate. An outrigger mechanism would also require the use of more complex components, thereby reducing reliability.

Figure 6:
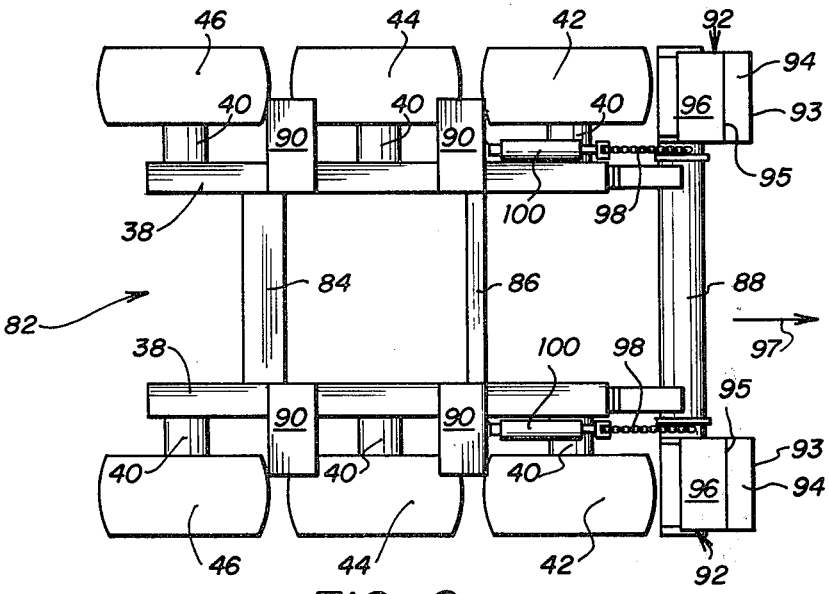
FIG. 6 is a top view of an undercarriage assembly employing a second embodiment of the present invention.
Figure 7:
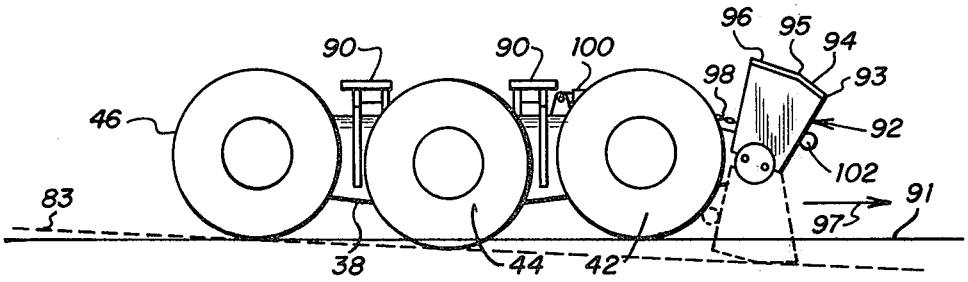
FIG. 7 is a side view of the undercarriage assembly of FIG. 6.

A second embodiment of the present invention is illustrated in FIGS. 6 and 7. In this embodiment, a frame assembly 82 supported on surface 83 is provided. The frame assembly includes a pair of aligned elongate hollow load-bearing frames 38. Frames 38 are rigidly interconnected by cross members 84 and 86 and cross tube 88 having a relatively uniform diameter along its length. Mounting pads 90 are rigidly secured to each of the frame assemblies 82 for mounting a mechanism.

The elongate hollow load-bearing frames 38 of frame assembly 82 rotatably support axle members 40 and forward, middle and rear sets of wheel members 42, 44 and 46. Again, the middle set of wheel members 44 extend below a plane 91 defined by the bottoms of the endmost sets of wheel members 42 and 46.

A pair of stabilizing jacks 92 are pivotally mounted at opposite ends of the cross tube 88 as shown in FIG. 6. Each jack 92 has a first edge 93 and a second edge 95, and a stepping face 94 and support face 96 formed thereon. A chain or cable 98 interconnects each jack 92 with a cylinder 100 mounted on each of the frames 38. Each jack further has a bar stop 102 mounted thereon for abutting against the adjacent wheel member 42 when the jack is in the support position as shown in dotted lines in FIG. 7.

The method of operation of the jacks 92 is identical to the operation of jacks 60. When frame assembly 82 is moved in the direction of arrow 97, the jacks 92 may be pivoted into the support position. Frame assembly 82 may be lowered off jacks 92 by moving in the direction opposite arrow 97. The cylinder 100 may be activated to pivot the jacks 92 into a storage position as shown in solid lines in FIG. 7. The use of a cross tube 88 permits the jacks to be separated a distance at least equivalent to the separation of the individual wheel members in each set to provide enhanced side stability of the undercarriage assembly.

Although several embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A vehicle supported on and propelled along a surface, comprising:

a pair of interconnected aligned elongate frames;

at least three wheel members rotatably supported along the length of each of said elongate frames;

the middle wheel members extending below a plane lying tangent to the bottoms of the endmost wheel members to facilitate skid steering;

means for rotating at least said middle wheel members to propel the vehicle along the surface; and a pair of jacks each pivotally mounted on the vehicle adjacent a first end of each of said frames, each of said jacks defining a rigid support extending from the pivotal mount to a support face;

the length of each jack from its pivotal support to its support face being greater than the distance from the pivotal support to the bottom of the wheel at said first end of the vehicle;

each of said jacks being engagable with the surface and responsive to movement of the vehicle in the direction of said ends of the frames under the action of at least said middle wheels for pivotal movement into an overcenter support position to support the first end of said frames on the surface so that the vehicle is supported on the jacks, the middle wheels and the wheels at the opposite end of the vehicle from said first end and is thereby prevented from rocking about said middle wheels; and said jacks being responsive to movement of the vehicle in the direction opposite said first ends of the frames for pivotal movement back to the original positions so that the vehicle is again supported solely by the wheel members.

2. The vehicle of claim 1 wherein each of said jacks is pivotal into a storage position out of engagement with the surface and the vehicle further comprises means for pivoting each of said jacks into the storage position.

3. The vehicle of claim 1 wherein said pair of elongate frames are interconnected by a cross tube between the first ends thereof, said pair of jacks being pivotally mounted on said cross tube.

4. A frame assembly for supporting and propelling a mechanism on a surface, comprising:

a pair of elongate hollow load-bearing frames positioned in a spaced apart relationship and rigidly interconnected;

at least three wheel members rotatably supported along the length of each of said load-bearing frames;

the middle wheel members extending below a plane lying tangent to the bottoms of the endmost wheel members;

means to rotate at least the middle wheel member of each of said load-bearing frames to propel the mechanism;

a pair of jacks each mounted at a first end of one of said load-bearing frames for pivotal motion from a storage position to a support position, each of said jacks defining a first edge for engagement with the surface as said jack is pivoted between said storage and support positions and responsive to movement of the mechanism in the direction of the first end of the frame under the action of at least the middle wheels for pivotal movement into the support position with said jack, said middle wheel member and the endmost wheel member adjacent the end of said frame opposite said first end supporting said frame on the surface and thereby preventing the vehicle from rocking endwise about the middle wheels; and each jack being responsive to movement of the mechanism in the direction opposite the first end of the frame for pivotal movement out of the support position and toward the storage position so that the mechanism is again supported solely by the wheel members.

5. The frame assembly of claim 4 wherein each of said load-bearing frames further comprises means to retain said jack in the storage position.

6. The frame assembly of claim 4 wherein said pair of elongate hollow load-bearing frames are rigidly interconnected by a cross tube between said first ends, said jacks being rotatably mounted at opposite ends of said cross tube adjacent said frames.

7. An improved vehicle of the type having at least three sets of wheel members to support the vehicle on a surface, the middle set of wheel members extending below a plane lying tangent to the bottom of the endmost sets of wheel members, the improvement which comprises:

a jack pivotally mounted on said vehicle adjacent a first set of endmost wheel members and responsive to movement of the vehicle in a predetermined direction under the action of at least some of the wheel members for pivotal movement overcenter to a support position so that the vehicle is supported on the surface by said jack, the middle set of wheel members and the endmost set of wheel members opposite said first set of endmost wheel members and is thereby prevented from rocking endwise about said middle set of wheel members;

said jack being responsive to movement of the vehicle in the opposite direction under the action of at least some of the wheel members for pivotal movement overcenter out of the support position so that the vehicle is once again supported solely by the wheel members.

* * * * *